US008955415B2

(12) United States Patent
Lin

(10) Patent No.: US 8,955,415 B2
(45) Date of Patent: Feb. 17, 2015

(54) REMOVAL TOOL

(71) Applicant: Fu-Hua Lin, Taichung (TW)

(72) Inventor: Fu-Hua Lin, Taichung (TW)

( * ) Notice: Subject to any disclaimer, the term of this patent is extended or adjusted under 35 U.S.C. 154(b) by 184 days.

(21) Appl. No.: 13/759,884

(22) Filed: Feb. 5, 2013

(65) Prior Publication Data

US 2014/0216214 A1 Aug. 7, 2014

(51) Int. Cl.
*B25B 27/18* (2006.01)

(52) U.S. Cl.
CPC ..... *B25B 27/18* (2013.01)
USPC ..... 81/53.2; 81/441

(58) Field of Classification Search
USPC ..... 81/53.2, 441
See application file for complete search history.

(56) References Cited

U.S. PATENT DOCUMENTS 2,480,648 A * 8/1949 Harer ..... 81/53.2
5,031,487 A * 7/1991 Polonsky ..... 81/53.2
5,251,516 A * 10/1993 Desaulniers ..... 81/53.2
6,349,624 B1 * 2/2002 Fahringer ..... 81/441
6,761,089 B2 * 7/2004 Bergamo ..... 81/53.2
7,152,509 B2 * 12/2006 McCalley et al. ..... 81/53.2
7,171,871 B2 * 2/2007 Kozak ..... 81/53.2
8,276,482 B2 * 10/2012 Kozak et al. ..... 81/53.2
8,448,547 B2 * 5/2013 Whitehead et al. ..... 81/53.2
8,579,180 B2 * 11/2013 Burford ..... 228/2.1
2008/0251571 A1 * 10/2008 Burford ..... 228/114.5

* cited by examiner

*Primary Examiner* — David B Thomas

(57) ABSTRACT

A removal tool includes an elongate rod. A first end of the elongate rod is to be connected to and driven by a drive device, and a second end of the elongate rod is connected integrally to the first end. A direction from the first end toward the second end, which is substantially parallel to a longitudinal center axis of the elongate rod, is defined as a first direction. Along the first direction the second end is conically tapered and formed with plural splines which obliquely extend relative to the longitudinal center axis according a twist direction, wherein the twist direction generally conforms to a direction in which the removal tool is used to unfasten a fastener. Each spline has a circumferential surface having plural first teeth which obliquely extend relative to the longitudinal center axis according to the twist direction along the first direction.

5 Claims, 9 Drawing Sheets

REMOVAL TOOL

BACKGROUND OF THE INVENTION

1. Field of the Invention

The present invention relates to a removal tool, more particularly, to a removal tool for a damaged fastener.

2. Description of the Prior Art

In many devices or mechanisms, plenty of fasteners (such as bolt, screw, nut, a threaded insert or the like) are used to connect parts. The fastener is usually driven by a tool such as wrench which is engaged with a head portion or a receiving hole of the fastener, and the wrench is then rotated to fasten or unfasten the fastener. However, many factors, such as that the fastener is fastened or unfastened for many times, that an improperly great force is applied to the fastener, or the properties of material of the fastener, can cause damage to the head portion or the receiving hole so that the fastener cannot be removed.

U.S. Pat. No. 6,575,057 is directed to a broken heater hose coupler removal tool. One end of the removal tool is adapted for being connected to and driven by a drive device, and the other end is formed with plural teeth which symmetrically extend and are parallel to a longitudinal center axis, namely, the teeth are untwisted. The teeth section includes an end section and a mid section. The end section and the mid section include respective fixed radial cross section areas, and the radial cross section area of the end section is smaller that of the mid section. The end section is inserted into the broken heater hose coupler in advance, the broken heater hose coupler is then removed through the engagement of the apexes of the teeth with the coupler. However, since the teeth are straight and parallel to the longitudinal center axis, and since the end section and the mid section include the respective fixed radial cross section areas, so that the removal tool has to be hammered to fit the teeth into the damaged coupler when the damaged coupler is to be removed. Therefore, the removal process is complicated and inconvenient, and the teeth cannot be wedged further into the damaged coupler when the removal tool is rotated, so that the removal tool can slip and rotate relative to the damaged coupler and the damaged coupler might be hard to be removed.

U.S. Pat. No. 1,875,484 is directed to a screw extractor. A plurality of ribs straightly extend along a longitudinal direction of the screw extractor on the circumferential surface. The screw is removed through the ribs being wedged into the screw. However, the straightly-extending ribs cannot be sufficiently and effectively wedged into the screw when the screw extractor is rotated, so that the screw extractor might slip and rotate relative to the screw and the screw might be hard to be removed.

TW I337116 is directed to damaged bolt and screw removing devices. The removing device includes a tip from which extend two or more notches separated by traction or biting surfaces formed from two-sided frusto-conically-shaped regions. The surfaces are bounded on one side by a nonlinear cutting edge and on the other side by a non-cutting edge and are configured to cut into the fastener when the bit is rotated in a direction opposite to the fastener's direction of engagement. Specific embodiments include configurations where the cutting edges extend at different angles with respect to the bit axis, where the biting surfaces comprise a plurality of serrations, and where the cutting edges are separated by flutes which spiral along a longitudinally extending periphery of the bit. However, since the serrations do not obliquely extend and twist relative to the longitudinal center axis, the serrations cannot be wedged further into the damaged bolt or screw when the removing device is rotated, so that the removing device can slip and rotate relative to the damaged bolt or screw and the damaged bolt or screw might be hard to be removed.

The present invention is, therefore, arisen to obviate or at least mitigate the above mentioned disadvantages.

SUMMARY OF THE INVENTION

The main object of the present invention is to provide a removal tool which can effectively be wedged into the damaged fastener so that the damaged fastener can be extracted effectively and rapidly.

To achieve the above and other objects, a removal tool of the present invention is adapted for removing a fastener which is fixed to an object and damaged. The fastener has a hole. A direction of unfastening the fastener relative to the object is defined as an unfastening direction. The removal tool includes an elongate rod. The elongate rod includes a longitudinal center axis and opposite first and second ends. The first end is for being connected to and driven by a drive device, and the second end is integrally connected to the first end. A direction from the first end toward the second end is defined as a first direction. The first direction is substantially parallel to the longitudinal center axis of the elongate rod. Along the first direction the second end is conically tapered and formed with a plurality of splines which obliquely extend relative to the longitudinal center axis according a twist direction. The twist direction generally conforms to the unfastening direction. Each spline includes a circumferential surface having a plurality of first teeth which obliquely extend relative to the longitudinal center axis according to the twist direction along the first direction. Each first tooth extends according to the twist direction along the first direction at a predetermined angle between 15-60 degrees relative to the longitudinal center axis.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
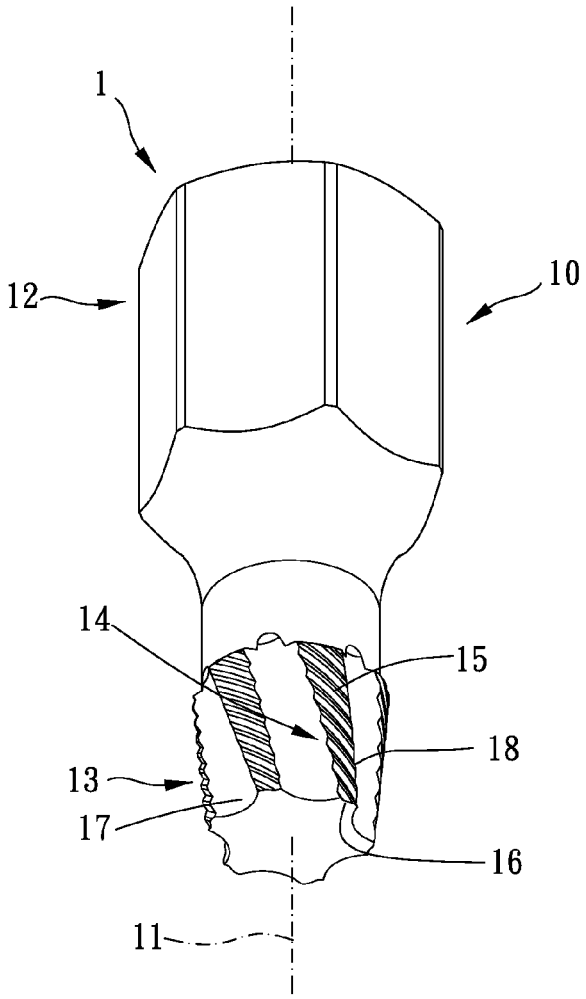
FIG. 1 is a perspective view of a removal tool according to a first embodiment of the present invention.
Figure 1A:
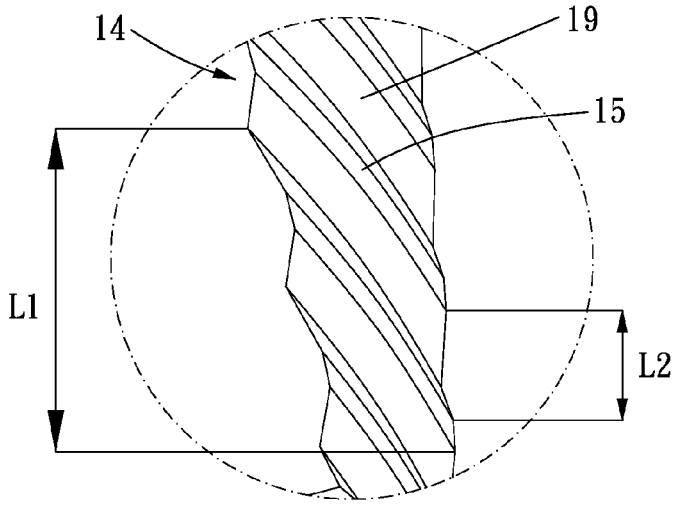
FIG. 1A is a partial enlarged drawing of FIG. 1.
Figure 2:
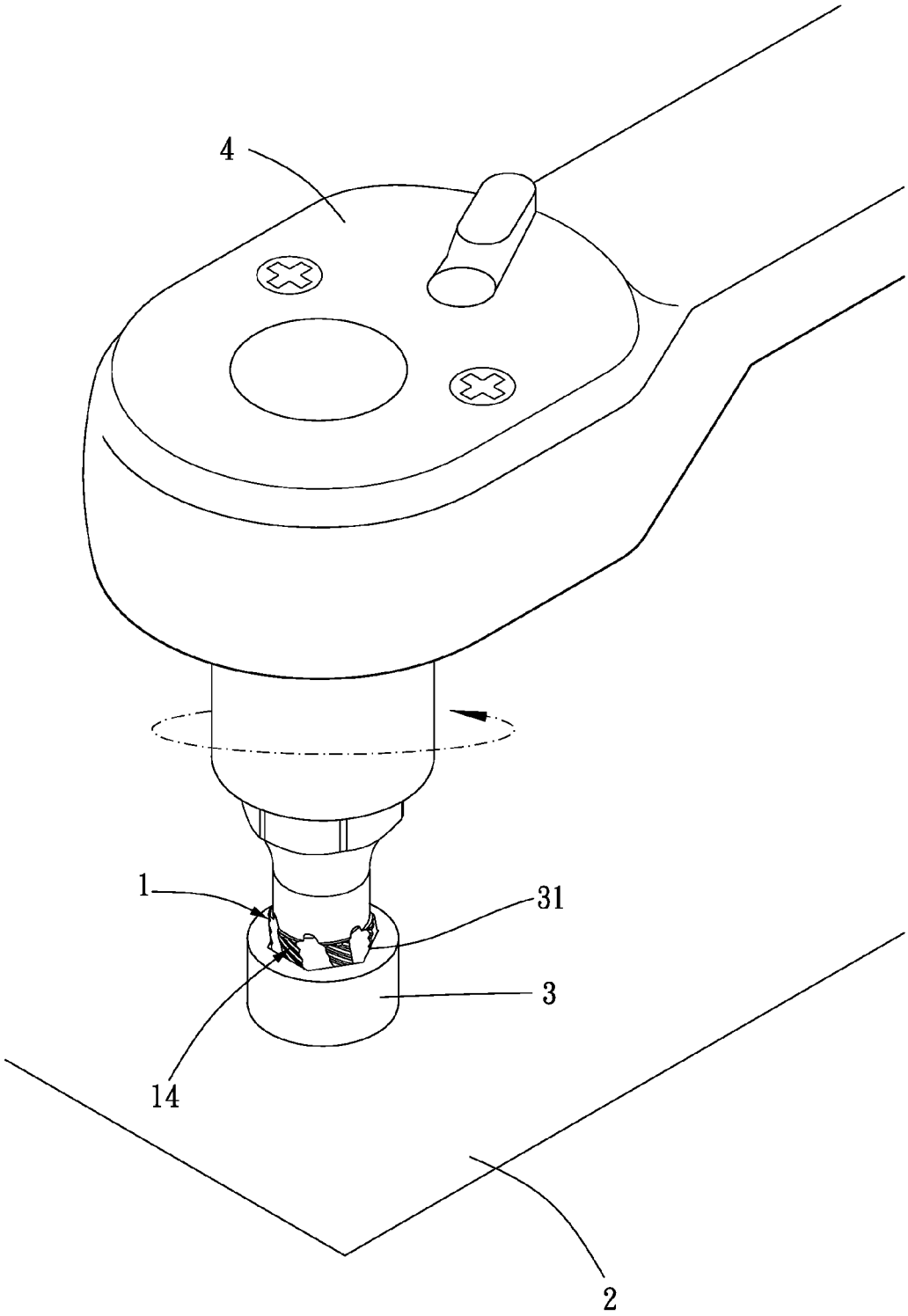
FIG. 2 is a drawing showing the removal tool in use according to the first embodiment of the present invention.

As shown in FIGS. 1, 1A and 2, a removal tool 1 of a first embodiment according to the present invention is provided. The removal tool 1 is adapted for removing a fastener 3 or connecting member which is fixed to an object 2 and damaged, wherein the fastener 3 has a hole 31. Relative to the object 2, a direction of unfastening the fastener 3 is defined as an unfastening direction. On the basis of an orientation as shown in FIG. 1, the unfastening direction is counterclockwise (as directed by the arrow shown in FIG. 2). It is noted that the unfastening direction should be defined actually according to each of various kinds of fasteners. In this embodiment, the fastener 3 is, for example, a bolt; however, the fastener 3 may be a screw, nut, a threaded insert or the like. The hole 31 may be formed at the time the fastener 3 is made, or the hole 31 may be additionally formed (such as by drilling) after the fastener 3 is made. The hole 31 may be but not limited to polygonal, multi-cornered or circular. The damage of the fastener 3 may be caused at the sidewall around the hole 31 or at the head of the fastener 3.

Figure 3:
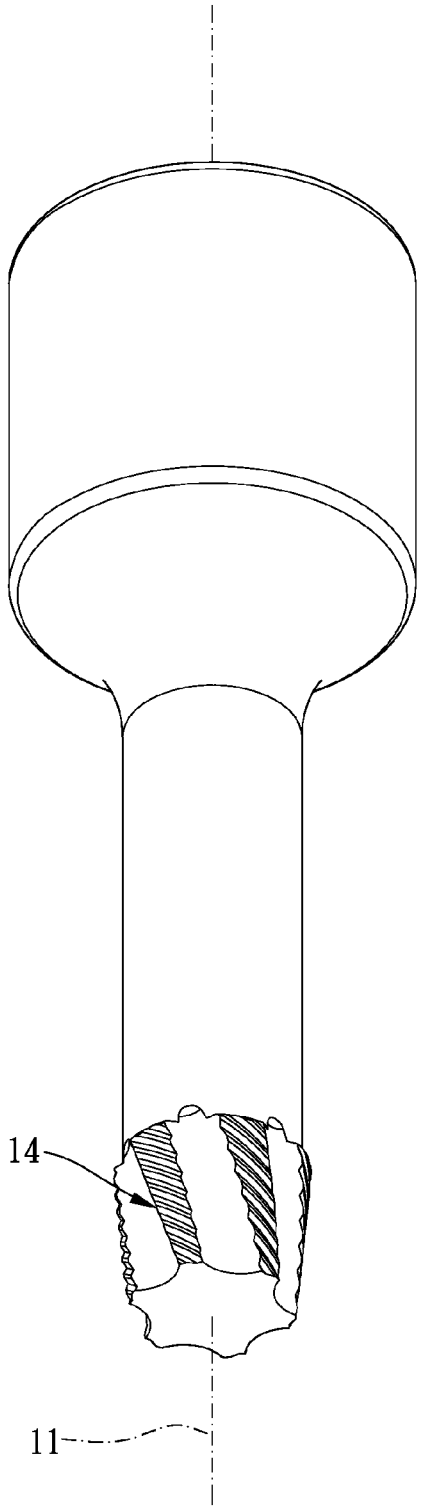
FIG. 3 is a perspective view of another removal tool according to the first embodiment of the present invention.
Figure 4:
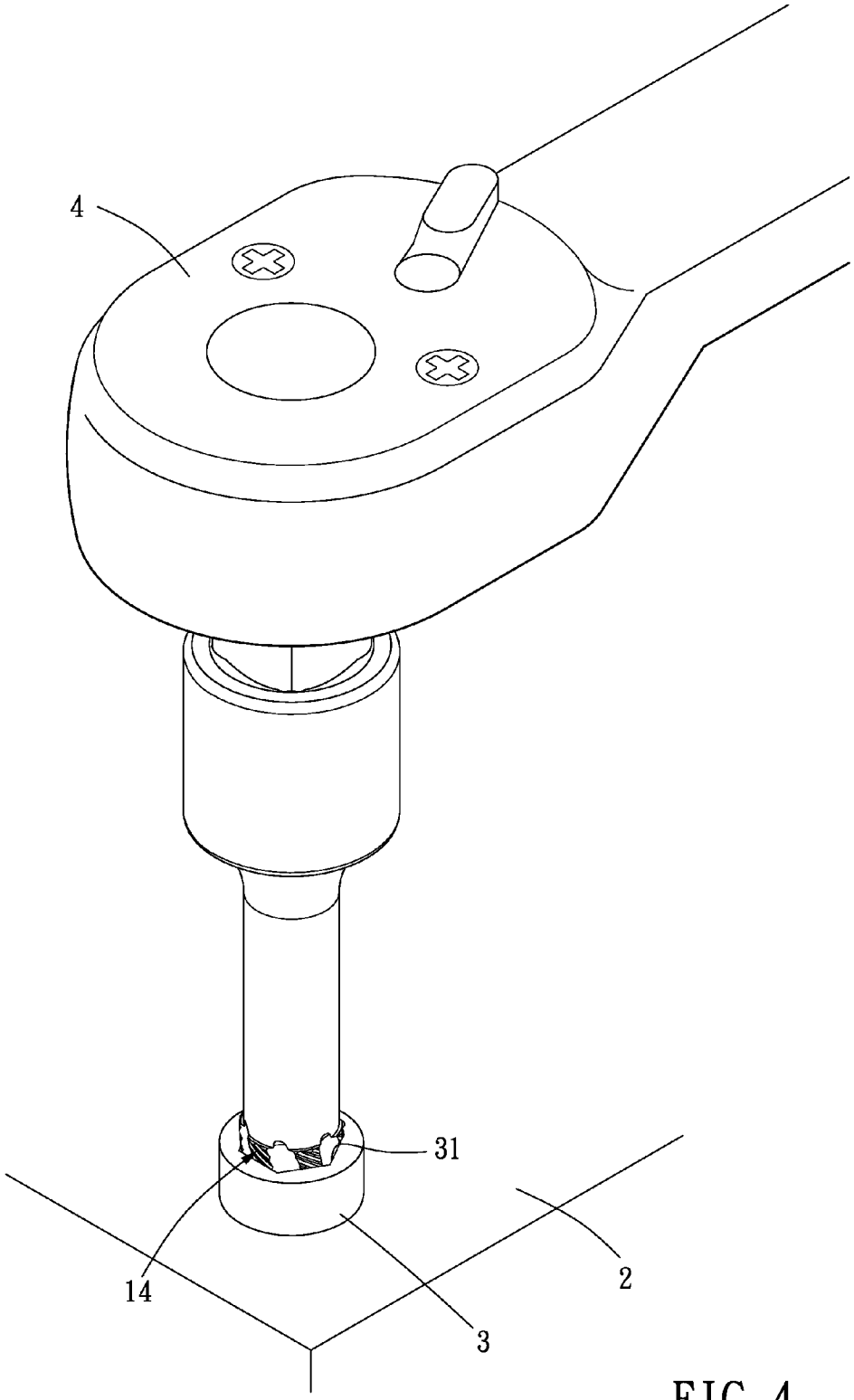
FIG. 4 is a drawing showing the another removal tool in use according to the first embodiment of the present invention.

The removal tool 1 includes an elongate rod 10. The elongate rod 10 includes a longitudinal center axis 11 and opposite first end 12 and second end 13. The first end 12 is adapted for being connected to and driven by a drive device, and the second end 13 is integrally connected to the first end 12. Specifically, the first end 12 includes a polygonal (such as hexagonal) cross section for engagement of a drive device such as wrench 4 (as shown in FIG. 2). An end face of the first end 12, which is traverse to the longitudinal center axis 11, may be formed with a receiving hole into which a drive device such as hex wrench is to be inserted (as shown in FIGS. 3 and 4). The first end 12 may be formed to have both the polygonal cross section and the receiving hole, so that the first end 12 can be selectively adapted for engagement with different drive devices, or for engagement with a drive device having portions which have shapes correspond to the polygonal cross section and the receiving hole.

In this embodiment, a direction from the first end 12 toward the second end 13 is defined as a first direction which is substantially parallel to the longitudinal center axis 11. Along the first direction, the second end 13 is conically tapered and formed with a plurality of splines 14. Specifically, the second end 13 is formed with six splines 14, and every two splines 14 generally oppositely located by two sides of the longitudinal center axis 11. The splines 14 obliquely extend and twist relative to the longitudinal center axis 11 according a twist direction, wherein the twist direction generally conforms to the unfastening direction. For example, in FIG. 1, each spline 14 obliquely extends from upper left to lower right, wherein each spline 14 obliquely extends according to the twist direction along the first direction relative to the longitudinal center axis 11 at an angle. The angle is not greater than 45 degrees, preferably between 5-30 degrees, more preferably smaller than 15 degrees, such that the splines 14 can be wedged into the fastener 3 easily and, along the twist direction, the splines 14 can provide a great circumferentially drive force so as to facilitate unfastening the damaged fastener. Each spline 14 includes a circumferential surface 16 having a plurality of first teeth 15 which obliquely extend relative to the longitudinal center axis 11 according to the twist direction along the first direction. For example, in FIG. 1, each first tooth 15 extends according to the twist direction along the first direction at a predetermined angle between 15-60 degrees relative to the longitudinal center axis 11. The predetermined angle is between 15-60 degrees, preferably between 15-45 degrees, more preferably between 15-30 degrees, such that the first teeth 15 can be wedged into the fastener 3 easily and, along the twist direction, the splines 14 can provide a great circumferentially drive force so as to facilitate unfastening the damaged fastener.

Preferably, every two adjacent splines 14 form a groove 17 therebetween, and each groove 17 shrinks along an extending direction thereof along the first direction. In another viewpoint, in a radial cross section of the second end 13, the circumferential extent of each spline 14 increases along an extending direction of the spline 14 along the first direction. As such, for each spline 14, although the second end 13 is conically tapered, a portion of the spline 14 relatively nearer the distal end of the second end 13, which has a relatively smaller radial dimension, can have a greater structural strength and excellent ability of wedging into and griping on the fastener 3. It is noted that each groove 17, preferably, shrinks along an extending direction thereof along the first direction. The groove 17 may be considered as to be recessed on a conical surface, or to be formed by every two adjacent splines 14 and a conical surface (every two adjacent splines 14 may be considered as to be protruded from the conical surface).

In this embodiment, along the first direction, the first teeth 15 of each spline 14 are separately distanced apart along an extending direction of the spline 14. Each first tooth 15 of each spline 14 includes an outmost radial corner edge 18, and each outmost radial corner edge 18 obliquely extends relative to the longitudinal center axis 11 according to the twist direction along the first direction, such that each outmost radial corner edge 18 can have excellent ability of wedging into and griping on the fastener 3.

Figure 5:
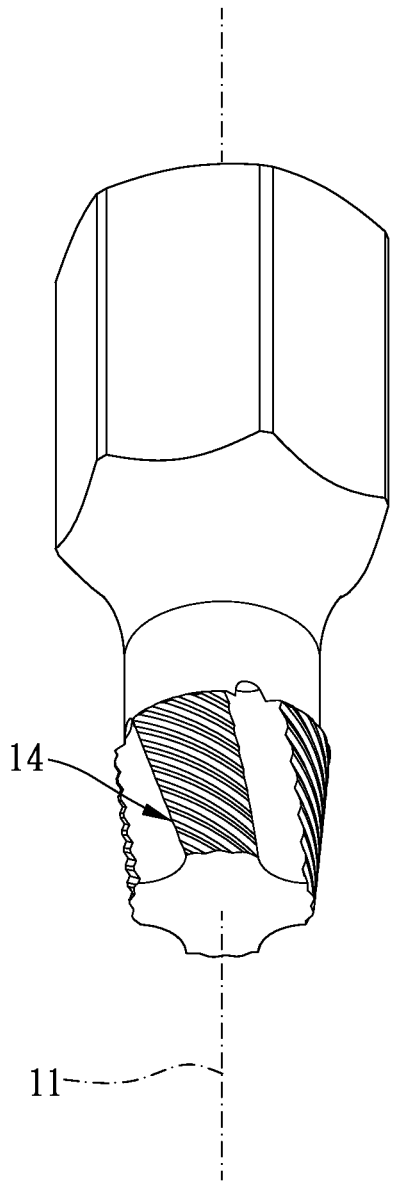
FIG. 5 is a perspective view of other removal tool according to the first embodiment of the present invention.

Preferably, every two adjacent first teeth 15 form a valley 19 therebetween, and each valley 19 shrinks along an extending direction thereof along the first direction. In another viewpoint, in a radial cross section of the second end 13, the circumferential extent of each first tooth 15 increases along an extending direction of the first tooth 15 along the first direction. As such, for each first tooth 15, although the second end 13 is conically tapered, a portion of the first tooth 15 relatively nearer the distal end of the second end 13, which has a relatively smaller radial dimension, can have a greater structural strength and excellent ability of wedging into and griping on the fastener 3. Along the first direction, a distance L1 between two ends of each first tooth 15 which traverses the corresponding circumferential surface 16 (i.e., from a valley 19 to the adjacent valley 19) is greater than a width L2 of the valley 19 adjacent to the first tooth 15, thus providing a great circumferentially drive force to facilitate unfastening the damaged fastener and providing excellent ability of wedging into and griping on the fastener 3. It is noted that the width of each valley 19 may increase along an extending direction thereof along the first direction; according to various requires, the width of each spline 14 may be modified or the number of the splines 14 may be (but is not limited to) 4, as shown in FIG. 5.

In an alternative embodiment, each spline may includes two or more parallel first teeth extending along an extending direction thereof. The first teeth may have radial extent difference so that the first teeth can be sequentially wedged into the fastener, thus enhancing the griping on the fastener and the effects of unfastening the fastener.

Figure 6:
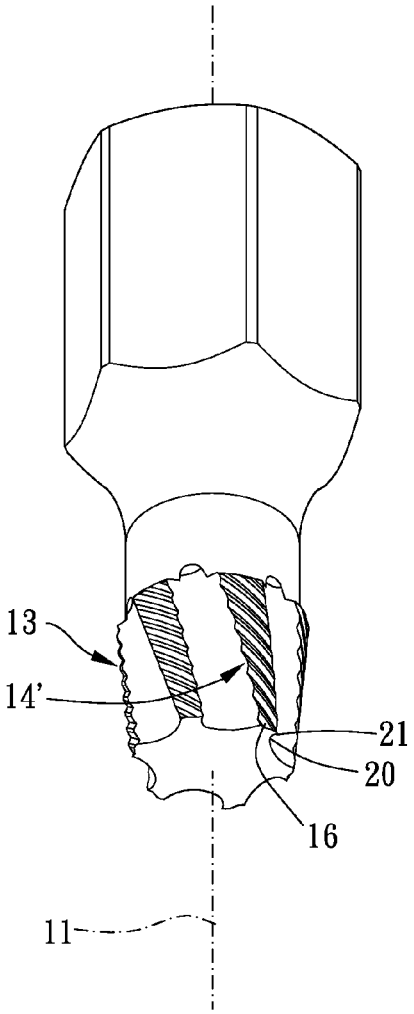
FIG. 6 is a perspective view of a removal tool according to a second embodiment of the present invention.

Compared to the first embodiment, in a second embodiment as shown in FIG. 6, along the first direction, a side surface of each spline 14' is formed with a long concave 20, and each long concave 20 extends along the extending direction of the spline 14' and faces in a direction generally conforming to the twist direction. Viewed in a radial cross section of the second end 13, the circumferential surface 16 of each spline 14' and corresponding long concave 20 merge to form a corner edge 21, and an extension line from the longitudinal center axis 11 toward the corner edge 21 passes through the long concave 20. Through this structure, each corner edge 21 can be wedged into the fastener more easily, and can provide a greater circumferential drag force to the fastener when the corner edge 21 was firmly wedged into the fastener so that the removal tool will not slip and rotate relative to the fastener, thus being able to effectively remove the damaged fastener.

Figure 7:
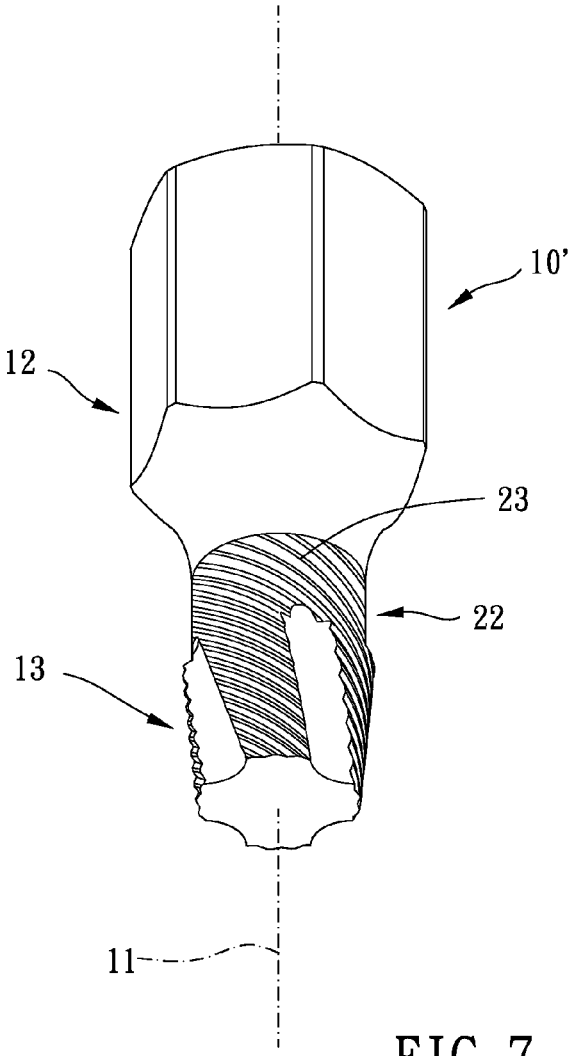
FIG. 7 is a perspective view of a removal tool according to a third embodiment of the present invention.

Compared to the first embodiment, in a third embodiment as shown in FIG. 7, an elongate rod 10' further includes a middle section 22 integrally connected between the first end 12 and the second end 13. Along the first direction, the middle section 22 is conically tapered and smoothly connected to the second end 13. More specifically, the middle section 22 and the second end 13 can be considered as two sections of a cone. An outer circumferential surface of the middle section 22 is formed with a plurality of second teeth 23 which obliquely extend relative to the longitudinal center axis 11 according to the twist direction along the first direction, wherein each second tooth 23 may have a structure the same as that of any type of the aforementioned first tooth. As the first teeth are wedged into the fastener and the second end 13 entirely sinks into the hole of the fastener or as the second end 13 entirely sinks into the hole of the fastener and the first teeth are not wedged into the fastener, the removal tool can firmly grip the fastener via the second teeth 23 being wedged into the fastener, such that the damaged fastener can be removed.

Figure 8:
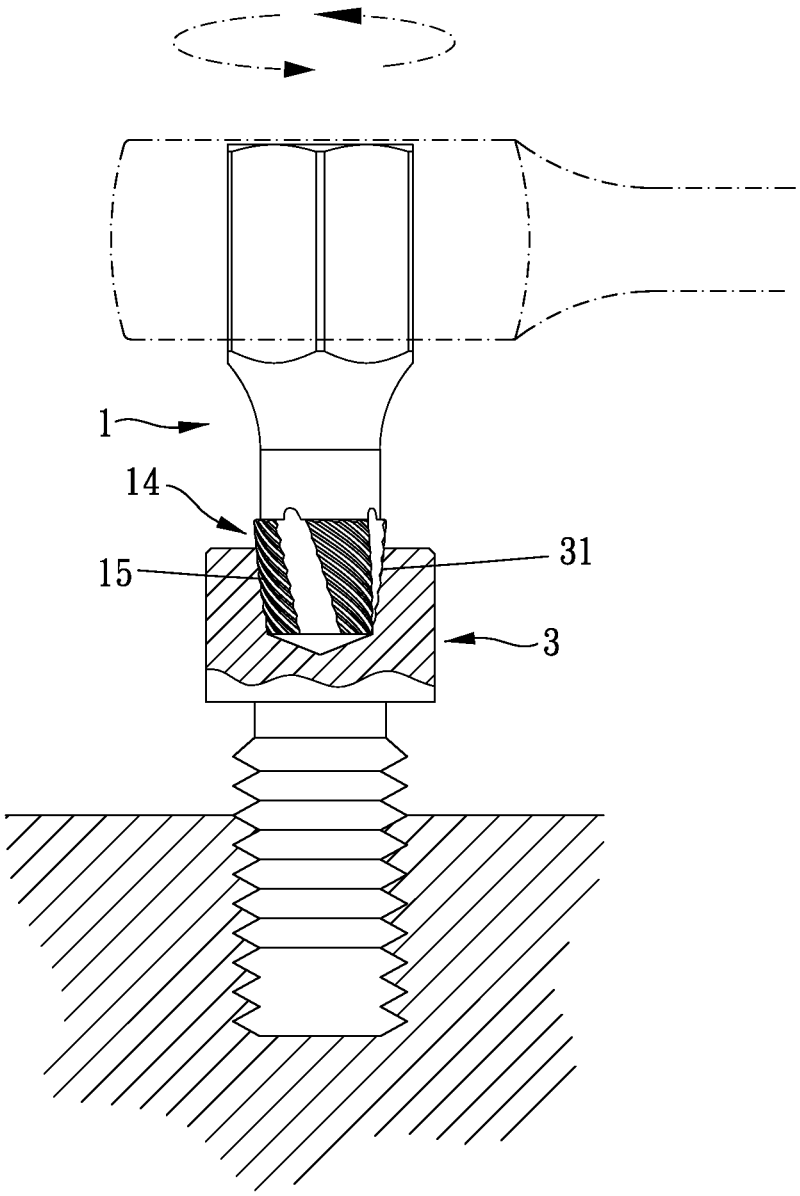
FIG. 8 is a drawing showing a removal tool used for removing a fastener having an abrade receiving hole according to the present invention.

As shown in FIGS. 1 and 8, for a fastener 3 with the damaged hole 31, the removal tool 1 can be inserted into the hole 31 and rotated by a tool such as wrench, and the splines 14 and the first teeth 15 of the removal tool 1 are obliquely wedged into the fastener 3 continuously so that the damaged fastener 3 can be favorably driven and removed.

Figure 9:
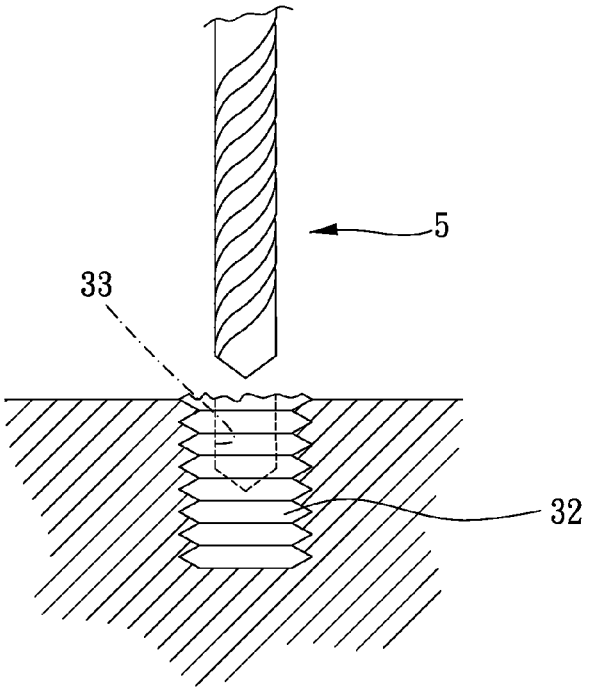
FIGS. 9 and 10 are drawings showing a removal tool used for removing a broken fastener according to the present invention.
Figure 10:
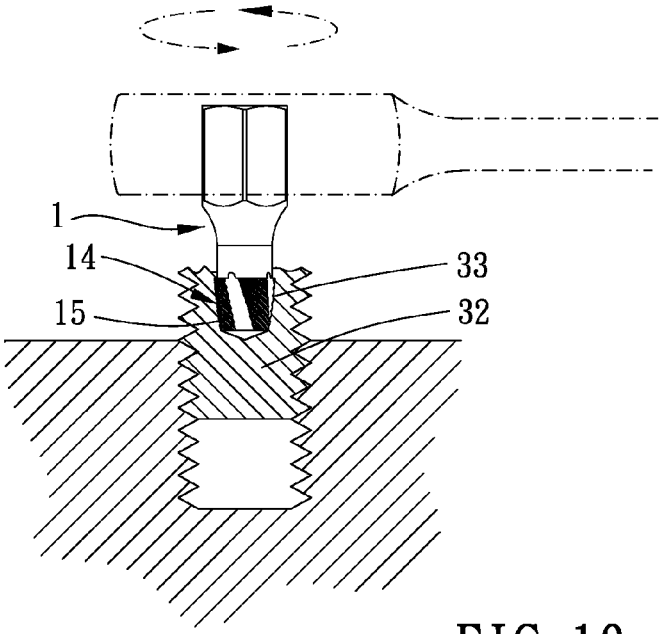

As shown in FIGS. 1, 9 and 10, for a broken fastener having merely a threaded rod body 32, a hole 33 may be formed on the end face of the threaded rod body 32 by a drill 5, the removal tool 1 is then inserted into the hole 33 and rotated by a tool such as wrench, and the splines 14 and the first teeth 15 of the removal tool 1 are obliquely wedged into the fastener 3 continuously so that the threaded rod body 32 can be favorably driven and removed.

During the removal of the damaged fastener, through the aforementioned removal tool 1 of the present invention, it has to rotate the removal tool only about 15-30 degrees (15 degrees or less for a best-designed removal tool), and each spline 14 and each first tooth 15 are sufficiently and effectively wedged into and griping on the fastener and can provide a greater circumferential drag force to rotate the fastener, so that it is sufficient, effective and quick to remove the damaged fastener.

It should be noted that, various kinds of removal tools are manufactured and tested by the applicant, and the results show that a removal tool having splines or/and first teeth not like that of aforementioned ones or without any splines or/and first teeth, the effect of the removal of the damaged fastener is poor.

Figure 11:
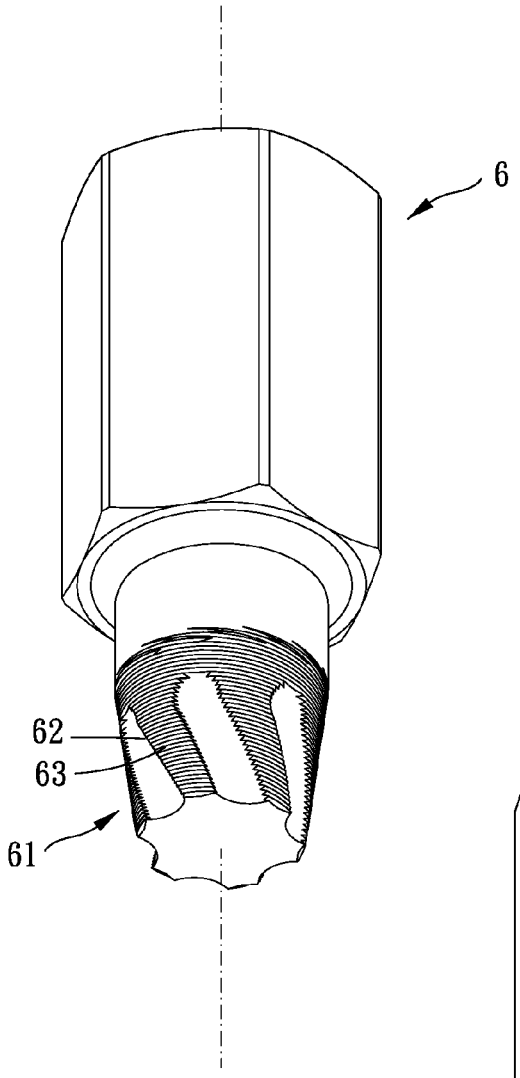
FIGS. 11 and 12 are drawings showing two other removal tools for removing a damaged fastener.

As shown in FIG. 11, a working end 61 of a removal tool 6 is formed with a plurality of separate splines 62. The outer circumferential surface of each spline 62 is formed with a plurality of threads 63 which are very closely arranged in parallel. The processing of the removal tool 6 is complicated, time-consuming and of high production cost. Additionally, each closely-arranged thread 63 is twisted relative to a longitudinal axis of the removal tool 6 by a great helical angle (at least greater than 80 degrees). When the removal tool 6 is used to remove a damaged fastener, the removal tool 6 has to be rotated around and around, and the damaged fastener cannot be rotated and removed until the threads 63 of the working end 61 are largely or wholly wedged into fastener and the circumferential sidewall of the working end 61 is unrotatably abutted against the fastener, and thus the effect of the removal of the damaged fastener is poor.

Figure 12:
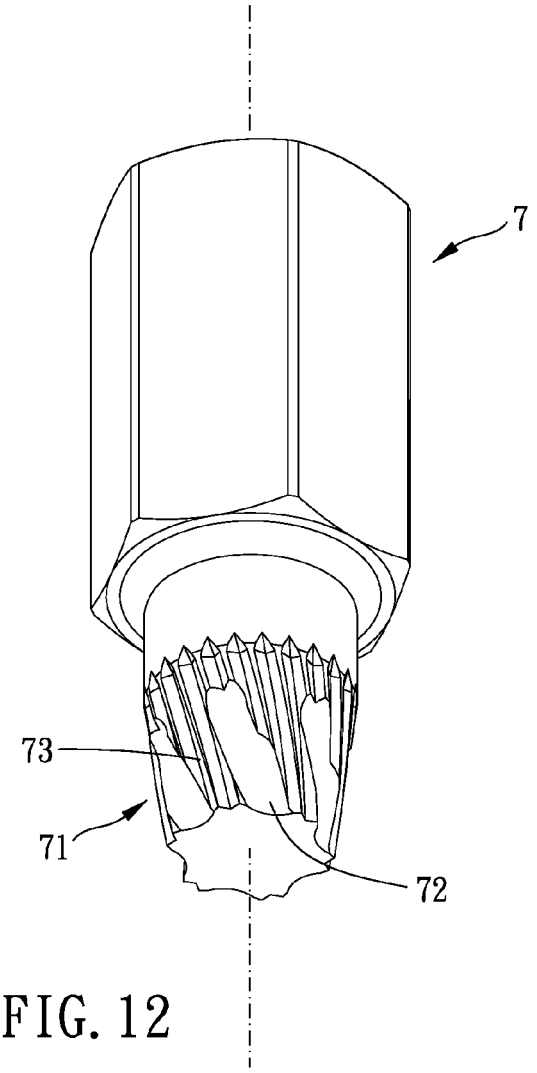

As shown in FIG. 12, a working end 71 of a removal tool 7 is formed with a plurality of separated splines 73 which are separated by grooves 72, wherein the splines 73 have different extending lengths. Each spline 73 is twisted relative to a longitudinal axis of the removal tool 7 by a small helical angle (less than 15 degrees), such that the splines 73 and the grooves 72 form few intersections which can be used to grip the fastener, and thus the removal tool 7 cannot grip firmly on the damaged fastener so that the effect of the removal of the damaged fastener is poor.

Given the above, in the present invention, the removal tool has the conically tapered second end formed with the splines, and each spline includes the obliquely-arranged (15-60 degrees) first teeth, whereby the removal tool can be sufficiently and effectively wedged into and grip on the damaged fastener so that the damaged fastener can be sufficiently, effectively and quickly driven and removed.

Furthermore, the splines or/and the first teeth may have improved structural strengths through being designed to have proper arrangement or/and dimension.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A removal tool, adapted for removing a fastener which is fixed to an object and damaged, the fastener having a hole, a direction of unfastening the fastener relative to the object being defined as an unfastening direction, the removal tool including:

an elongate rod, including a longitudinal center axis and opposite first and second ends, the first end for being connected to and driven by a drive device, the second end being integrally connected to the first end;

wherein a direction from the first end toward the second end is defined as a first direction, the first direction being substantially parallel to the longitudinal center axis of the elongate rod, along the first direction the second end being conically tapered and formed with a plurality of splines which obliquely extend relative to the longitudinal center axis according a twist direction, the twist direction generally conforming to the unfastening direction, each spline including a circumferential surface having a plurality of first teeth which obliquely extend relative to the longitudinal center axis according to the twist direction along the first direction, each first tooth extending according to the twist direction along the first direction at a predetermined angle between 15-60 degrees relative to the longitudinal center axis;

wherein every two adjacent first teeth form a valley therebetween, along the first direction a distance between two ends of each first tooth which traverses the corresponding circumferential surface is greater than a width of the valley adjacent to the first tooth.

2. The removal tool of claim 1, wherein along the first direction the first teeth of each spline are separately distanced apart along an extending direction of the spline.

3. The removal tool of claim 1, wherein the predetermined angle of each spline is not greater than 45 degrees.

4. A removal tool, adapted for removing a fastener which is fixed to an object and damaged, the fastener having a hole, a direction of unfastening the fastener relative to the object being defined as an unfastening direction, the removal tool including:

an elongate rod, including a longitudinal center axis and opposite first and second ends, the first end for being connected to and driven by a drive device, the second end being integrally connected to the first end;

wherein a direction from the first end toward the second end is defined as a first direction, the first direction being substantially parallel to the longitudinal center axis of the elongate rod, along the first direction the second end being conically tapered and formed with a plurality of splines which obliquely extend relative to the longitudinal center axis according a twist direction, the twist direction generally conforming to the unfastening direction, each spline including a circumferential surface having a plurality of first teeth which obliquely extend relative to the longitudinal center axis according to the twist direction along the first direction, each first tooth extending according to the twist direction along the first direction at a predetermined angle between 15-60 degrees relative to the longitudinal center axis;

wherein every two adjacent splines form a groove therebetween, and each groove shrinks along an extending direction thereof along the first direction.

5. A removal tool, adapted for removing a fastener which is fixed to an object and damaged, the fastener having a hole, a direction of unfastening the fastener relative to the object being defined as an unfastening direction, the removal tool including:

an elongate rod, including a longitudinal center axis and opposite first and second ends, the first end for being connected to and driven by a drive device, the second end being integrally connected to the first end;

wherein a direction from the first end toward the second end is defined as a first direction, the first direction being substantially parallel to the longitudinal center axis of the elongate rod, along the first direction the second end being conically tapered and formed with a plurality of splines which obliquely extend relative to the longitudinal center axis according a twist direction, the twist direction generally conforming to the unfastening direction, each spline including a circumferential surface having a plurality of first teeth which obliquely extend relative to the longitudinal center axis according to the twist direction along the first direction, each first tooth extending according to the twist direction along the first direction at a predetermined angle between 15-60 degrees relative to the longitudinal center axis;

wherein every two adjacent first teeth form a valley therebetween, and each valley shrinks along an extending direction thereof along the first direction.

* * * * *